US007057976B2

(12) United States Patent
Berseth et al.

(10) Patent No.: US 7,057,976 B2
(45) Date of Patent: Jun. 6, 2006

(54) ELECTRONIC TIMEPIECE ABLE TO BE WORN ON THE WRIST FOR COUNTING GOLF SCORE

(75) Inventors: Vincent Berseth, Neuchâtel (CH); Jean-Jacques Born, Morges (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 11/199,368

(22) Filed: Aug. 9, 2005

(65) Prior Publication Data

US 2006/0034160 A1 Feb. 16, 2006

(30) Foreign Application Priority Data

Aug. 10, 2004 (EP) ..... 04018935

(51) Int. Cl.
*G04B 47/00* (2006.01)
*G04B 19/04* (2006.01)

(52) U.S. Cl. ..... 368/10; 368/80; 473/213

(58) Field of Classification Search ..... 368/10, 368/80, 223; 473/213
See application file for complete search history.

(56) References Cited

U.S. PATENT DOCUMENTS 5,216,641 A * 6/1993 Hoel ..... 368/10
5,386,990 A * 2/1995 Smith ..... 473/131
5,523,985 A * 6/1996 Nixon ..... 368/107
5,550,884 A 8/1996 Berney
6,125,081 A 9/2000 Flynn
6,456,568 B1 * 9/2002 Geiger ..... 368/10
6,543,681 B1 * 4/2003 Wiederrecht et al. ..... 235/60 C
6,646,958 B1 * 11/2003 Geiger ..... 368/10

FOREIGN PATENT DOCUMENTS

EP 738 944 A1 5/1996
WO WO 94 21338 A1 9/1994

* cited by examiner

*Primary Examiner*—Vit W. Miska
(74) *Attorney, Agent, or Firm*—Sughrue Mion, PLLC

(57) ABSTRACT

The present invention concerns a portable electronic timepiece including analogue display means. Preferably, the analogue display means include hour (9), minute (10) and second (11) hands and two concentric date display rings (15, 16) visible through a large aperture (14), said different display members being driven independently of each other. The electronic circuits (20) of the timepiece are arranged for keeping a golf score in a particular operating mode, called the golf mode. The use of current time display means for displaying information relating to golf play means that the timepiece is easy to read in golf mode. The electronic circuits are also arranged to allow the wearer of the timepiece to display, particularly, the scores of any hole already played at any time during the game, owing to intuitive manipulations of a single control member (8).

12 Claims, 3 Drawing Sheets

ELECTRONIC TIMEPIECE ABLE TO BE WORN ON THE WRIST FOR COUNTING GOLF SCORE

FIELD OF THE INVENTION

The present invention concerns a portable electronic timepiece with a golf score keeping function comprising a case containing a watch movement above which there is mounted a dial. The watch movement comprises electronic circuits capable of generating time signals to be sent to motor means respectively controlling at least one first and one second analogue display member. These latter are arranged above the dial for displaying the current time in a first operating mode called the time mode.

BACKGROUND OF THE INVENTION

Watches having a golf score keeping function are already known from the prior art.

International Patent Application No. WO 94/21338 A1 discloses an electronic watch with an analogue display enabling its user to count the number of strokes played during a game of golf.

A basic principle of the watch disclosed in this Patent Application, which is common to all of the embodiments described, consists in using small off-centre counters on the dial, like a chronograph display, with which small hands are associated. The electronic circuits of the watch are arranged for controlling motor means driving the small hands, such that they indicate data relating to playing golf, in a golf score keeping operating mode.

The International Application further implements a large extra centred hand for completing the display of the small hands in the golf mode, suitable scales being provided on a bezel and/or on the dial of the watch.

However, such an electronic device proves complex to use, both as regards handling and reading its display. Comprehension of the data displayed relating to playing golf quickly becomes complicated if one considers, more particularly, the number of scales featured on the watch, some of them being also of reduced size.

SUMMARY OF THE INVENTION

It is a first object of the present invention to overcome the aforementioned drawbacks of the prior art by proposing a portable electronic timepiece providing its user with data relating to the playing of golf in an intuitive and legible manner.

Thus, the invention provides a portable electronic timepiece of the aforementioned type characterized in that it has a second operating mode, or golf mode, in which the electronic circuits are arranged for generating control signals to be sent to motor means, to display data relating to playing golf, by the first and second analogue display members.

In particular, the data relating to playing golf of interest to a player is the number of strokes played at each hole and an indication of the number of the hole being played.

It is another object of the invention to propose a portable electronic timepiece allowing the user to access, at a given moment, previously stored data relating to a game of golf in a simple, quick and legible manner.

Thus, the timepiece according to the present invention is provided with a control member and storage means allowing the user to input and store data related to the game of golf in progress. According to an advantageous characteristic of the present invention, the electronic circuit of the timepiece is also arranged so as to allow the user to visualize previously stored data, such as the number of strokes played at any of the preceding holes, in response to a predefined manipulation of the control member.

Moreover, additional display means can be provided in order to display the value of the total number of strokes played from the start of a game in progress. According to a preferred embodiment, such display means are made in the form of a digital display, visible through a suitable aperture made in the timepiece dial.

According to another preferred embodiment of the timepiece according to the present invention, a third analogue display member is implemented for indicating additional information relating to playing golf, this third display member indicating for example the second in the time mode.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE INVENTION

Figure 1:
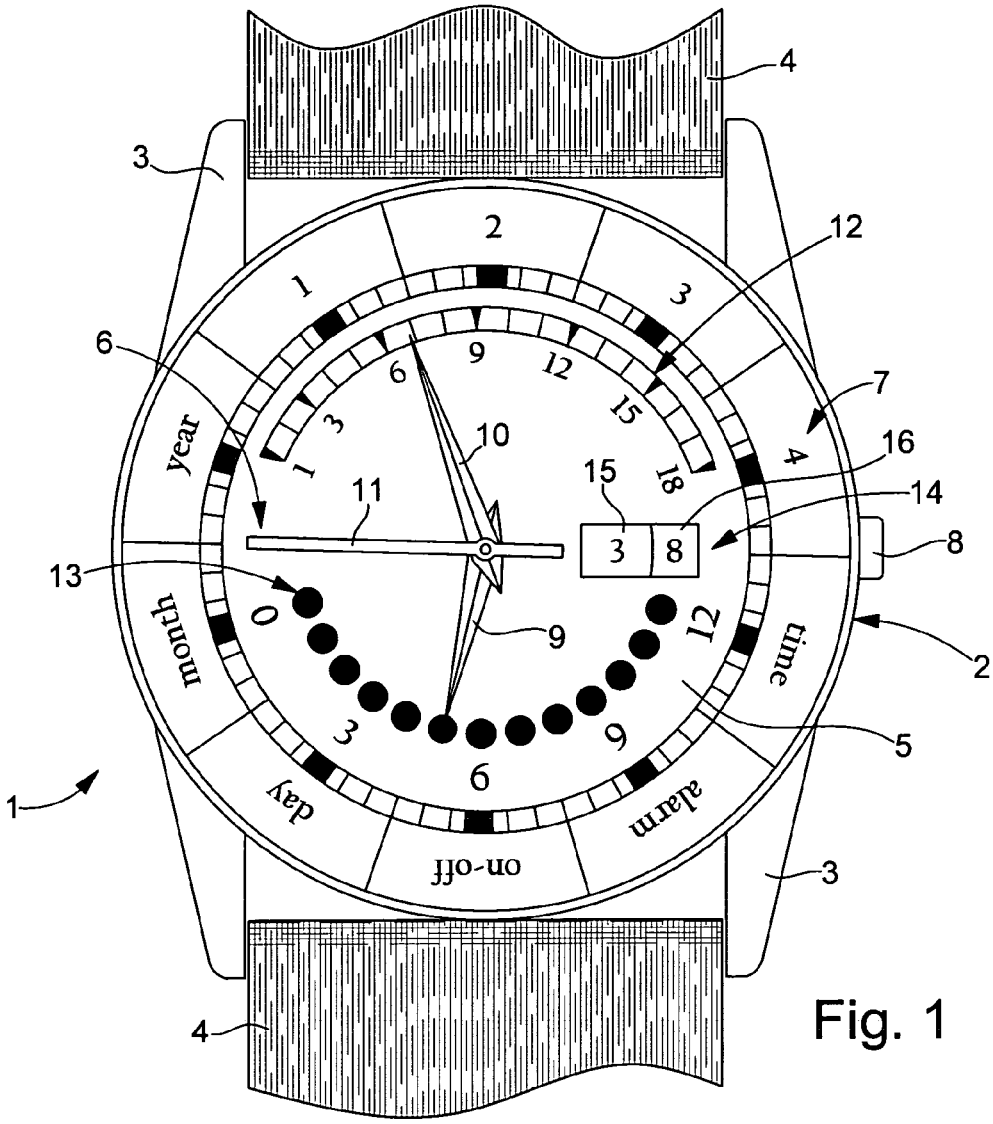
FIG. 1 shows a schematic front view of a portable electronic timepiece according to a first preferred embodiment of the present invention.

FIG. 1 shows an example of a first preferred embodiment of a portable electronic timepiece 1 or wristwatch according to the present invention.

Watch 1 looks like a conventional type of watch. It includes, in fact, a case 2 that can, for example, be of the moulded back-cover—middle part type, made of plastic material or metal , comprising horns 3 provided for attaching a wristband 4 and containing in particular a watch movement (not shown), a dial 5. Case 2 is closed on its top face by a crystal 6 over the periphery of which a bezel 7 is mounted. Watch 1 further includes a control member 8, namely a stem-crown, able to be used in particular as a push-button in addition to its conventional use in rotation.

Bezel 7 bears contiguous sectors comprising indications relating to various operating modes of watch 1. Indeed, according to a preferred embodiment, bezel 7 can fulfil the function of an additional control member for selecting, in particular, the operating mode of watch 1.

Those skilled in the art will be able to implement the teaching of EP Patent No. 0 738 944, incorporated herein by reference, disclosing a bezel structure fulfilling the control member function by using "reed" type contacts, namely contacts using interactions between permanent magnets. The teaching of this Patent forms a non-limiting example of this type of control member that is particularly suited to implementing the present invention.

Watch 1 also comprises three hands, respectively for indicating the hours 9, minutes 10 and seconds 11, in a first time operating mode.

Dial 5 bears first circular scales 12 comprising numbers from 1 to 18, the function of which will be explained hereinafter, and extending in the clockwise rotational direction substantially between the 10 o'clock and 2 o'clock positions. The dial further comprises second circular scales 13 comprising numbers from 0 to 12 and extending in the anti-clockwise rotational direction substantially between 8 o'clock and 4 o'clock. The second scales 13 are shown here in the form of dots, however is it clear that the present invention is not limited to the appearance shown and described for scales 12 and 13 of dial 5 and those skilled in the art will be able to implement any other suitable scale shape without departing from the scope of the present invention.

Dial 5 also comprises an aperture 14, generally called a large aperture, through which two portions of rings 15, 16 appear, bearing numbers, respectively "3" and "8" in the configuration shown.

In the time mode, aperture 14 is used in conjunction with rings 15, 16 for displaying the date.

Watch 1 according to the present invention comprises at least a second operating mode, called the golf mode, in which it can be used for counting the score during a game of golf.

According to the first preferred embodiment of watch 1, in accordance with the present invention, hour and minute hands 9 and 10 are controlled to indicate, respectively, the number of strokes played at a given hole of a golf course and the number of the hole in question, facing, respectively, second 13 and first 12 scales of dial 5. Thus, according to the example shown in FIG. 1, second scales 13 show shapes recalling the shape of a golf ball to enable the user to identify more quickly the information that they indicate, namely the number of strokes played at the hole in question.

Moreover, second hand 11 is controlled in the golf mode such that it remains still facing the position corresponding to 9 o'clock to indicate to the wearer of watch 1 that hour and minute hands 9 and 10 are not indicating the current time. Of course, the behaviour of second hand 11 in the golf mode is described by way of non-limiting example and those skilled in the art will be able to provide different behaviour for this hand without departing from the scope of the present invention.

In golf mode, rings 15, 16 are controlled to indicate the total number of strokes played since the start of the game. Thus, in the example shown, the wearer of watch 1 has already played 38 strokes in total, whereas minute hand 10 indicates that he is playing the seventh hole of the course at which he has already played five strokes, which is indicated by hour hand 9.

Figure 1A:
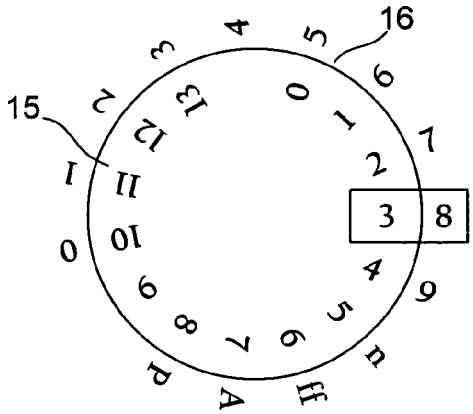
FIG. 1*a* shows schematically the constituent parts of the portable electronic timepiece shown in FIG. 1.

FIG. 1*a* shows schematically the two rings 15, 16 and more particularly, the markings that they bear. In addition to the markings "0" to "3" of a conventional date disc, inner ring 15 comprises markings dedicated to playing golf extending from "4" to "13". Likewise, in addition to the conventional "0" to "9" markings, outer ring 16 comprises markings relating to the additional operating modes of watch 1 "n", "ff", "A" and "P". The working of the additional markings will be explained in detail hereinafter.

Figure 2:
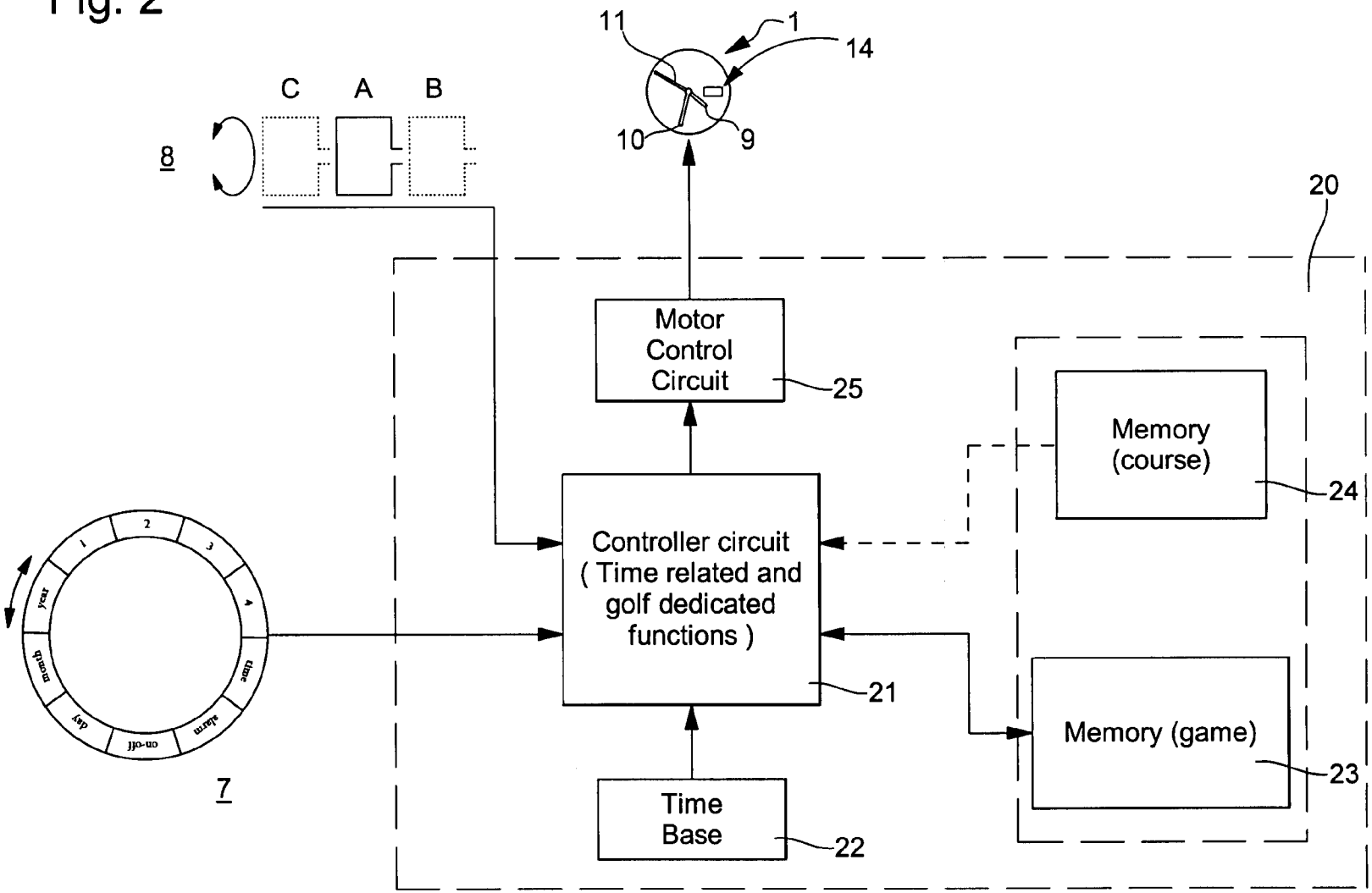
FIG. 2 shows a general schematic diagram of the electronic circuit of the portable electronic timepiece shown in FIG. 1.

Implementation of the functions described hereinbefore is explained in relation to FIG. 2 which shows a schematic diagram of the general structure of the electronic circuit of the electronic timepiece according to the present invention.

Generally, the electronic circuit of watch 1 comprises an integrated circuit 20 including a controller circuit 21 able to manage the conventional time functions of watch 1 comprising, for this purpose, a time division circuit, controller circuit 21 being connected in particular to a resonator 22 acting as a time base. From this time base, time related information is generated by controller circuit 21, particularly for carrying out the time mode functions and functions relating to additional operating modes.

Integrated circuit 20 also comprises memory zones, particularly a first memory zone 23, which may be of the volatile type, in which results of calculations carried out by controller circuit 21 are periodically stored. This first memory zone 23 is provided for storing the scores at each hole in addition to the total number of strokes played, during a game of golf. One particular architecture that could be envisaged for memory zone 23 consists, for example, in providing 18 registers, one register being associated with each hole of a golf course. An additional register could also be provided for storing the value of the total number of strokes played since the start of a game.

In time mode, controller circuit 21 is arranged for sending suitable signals to a motor means control circuit 25, for example five two-directional motors, such that hands 9, 10 and 11 display the current time, while rings 15 and 16 display the date facing large aperture 14.

Moreover, integrated circuit 20 of the watch comprises conventional means (not shown) for detecting pressure applied by the user to stem-crown 8 and when the latter is driven in rotation in one direction or the other. The stem-crown is in position A at rest and has two end axial positions, one instable B and one stable C.

Moreover, according to the preferred embodiment described in relation to the diagram of FIG. 1, bezel 7 of watch 1 also fulfils the function of a control member. Thus, integrated circuit 20 of the watch comprises conventional means for detecting rotational movements of the bezel in one direction or the other. More specifically, the integrated circuit is arranged such that a particular operating mode of watch 1 corresponds to each of the sectors borne by bezel 7. Preferably, integrated circuit 20 is arranged such that, following a change of operating mode, the mode being used corresponds to the indication of the sector placed at 12 o'clock. In a conventional manner, the operating mode selected by rotating the bezel is activated in response to a short application of pressure on stem-crown 8.

Preferably, the time and golf operating modes are deactivated when another operating mode is activated by the above procedure, whereas the additional operating modes are automatically deactivated after several seconds of inactivity, to return to the time mode.

In accordance with the example provided by way of non-limiting illustration, bezel 7 comprises successive sectors bearing figures from "1" to "4". The use of these four sectors allows the golf counter function of the watch according to the present invention to be implemented for a number of players ranging from 1 to 4. Thus, in the configuration shown in FIG. 1, the score of the second player is indicated by the watch display means when the sector bearing the figure "2" is placed at 12 o'clock. It is thus clear that, if the user rotates bezel 7 to place the sector bearing the figure "3" at 12 o'clock, then presses briefly on stem-crown 8, the display means are controlled by integrated circuit 20, via motor control circuit 25, so that they display the score of the third player.

One sector of bezel 7 bears the indication "time" and activates the time mode when it is placed at 12 o'clock before a short application of pressure is made on stem-crown 8.

Furthermore, conventional means well known to those skilled in the art are implemented in order to correct the current time indicated by hands 9 and 10, in time mode, when stem-crown 8 is pulled out into stable position C.

Moreover, when the current time correction mode is activated as indicated hereinbefore, inner ring 15 is preferably controlled such that it is placed with no markings visible in aperture 14, whereas outer ring 16 is arranged such that one of the aforementioned markings "A" or "P" is visible through aperture 14. These markings inform the wearer of the watch as to the nature of the 12 hour cycle in progress, in other words whether the current time indicated is "a.m." (ante meridiem) or "p.m." (post meridiem), which typically has an influence on the moment at which the displayed date is changed.

Alternatively or by way of complement, the indication of the 12 hour cycle can be displayed by the indication "12" for the morning and "24" for the afternoon by rings 15 and 16, through large aperture 14. In the second case, the passage from one type of display to the other is carried out from the time mode, by a long application of pressure on stem-crown 8, then by rotating it to alternate the indications "A" and "24" in the large aperture for example.

Additional operating modes of watch 1 are also described here by way of non-limiting example, controller circuit 21 being programmed in a conventional manner to manage a perpetual calendar function. Bezel 7 of watch 1 as shown in FIG. 1 thus comprises a sector bearing an indication "day" corresponding to a date adjustment function, a sector bearing the indication "month" corresponding to a display function of the current month in the large aperture, in order to correct the value thereof, a similar function being provided for adjusting the current year by positioning a sector bearing the indication "year" at 12 o'clock. Preferably, adjustments of the respective values of the date, month and year are made, in a conventional manner, by rotating stem-crown 8 once the desired function has been selected via bezel 7. Stem-crown 8 is generally in its pulled-out position C in order to activate its adjustment function so as to prevent any risk of inadvertent manipulations.

A sector bearing the indication "alarm" is also shown by way of illustration on the bezel of FIG. 1, a predefined alarm time then being indicated by hands 9 and 10 when this sector is placed at 12 o'clock. The alarm time setting is preferably altered by rotating stem-crown 8 when the latter is placed in its pulled-out position C, whereas the operating mode is set at "alarm". In this alarm display and setting mode, rings 15 and 16 can optionally be used to indicate to the wearer of the watch the 12 hour cycle corresponding to the set alarm time, as in the current time correction mode.

An additional operating mode is provided and activated by an arrangement of bezel 7 such that a sector bearing the indication "on-off" is placed at 12 o'clock. This operating mode is provided for activating or deactivating the alarm function, preferably by rotating stem-crown 8 in its pulled-out position C. In this operating mode too, rings 15 and 16 are used to inform the wearer of watch 1 as to the state of the alarm function. Inner ring 15 is arranged so as to make the marking "0" appear facing aperture 14, whereas outer ring 16 is arranged so as to make the markings "ff" or "n" appear depending upon whether the alarm function is respectively off or on. Thus in this "on-off" mode, at each new rotation of stem-crown 8 in one direction or the other, ring 16 is driven in rotation in one direction then in the other so that the large aperture alternatively displays the "Off" or "On" indication. Alternatively, inner ring 15 could comprise a specific position bearing the indication "O" rather than using the "0" already used in the date display.

It is also possible to combine the two modes relating to the alarm into a single mode in which the alarm time display is indicated by the indication "On" or "Off" displayed in aperture 14. Likewise, in this case, the alarm time can be set by rotating stem-crown 8, the latter being placed in its pulled-out position C. Moreover, the state of activation of the alarm function can be altered directly by pressure on stem-crown 8 in its pushed-in position B.

The operation of watch 1 as a golf counter will now be described in more detail. As mentioned hereinbefore, the golf counter function is activated when bezel 7 of watch 1 is placed such that one of the sectors bearing the indications "1" to "4" is located at 12 o'clock, as is the case in the diagram of FIG. 1, the stem-crown 8 being briefly pressed towards its pushed-in position B.

A preferred method of programming integrated circuit 20 of watch 1 according to the present invention consists in providing that, in golf mode, passage from the display of information relating to a given hole to display of information relating to another hole occurs in response to detection of rotation of stem-crown 8, the latter being placed in its rest position A.

During a game of golf, when watch 1 is in golf mode, integrated circuit 20 is programmed to increment the number of strokes played for a given hole in response to detection of a short application of pressure on stem-crown 8 bringing it into its pushed-in position B.

At the same time, integrated circuit 20 is also programmed to store the value of the total number of strokes played since the start of a game and to produce a suitable electrical signal to be sent to motor control circuit 25. On the basis of this signal, the motor control circuit causes rings 15 and 16 to be driven such that they display this value through aperture 14. Thus, each short application of pressure on stem-crown 8 during the game has the effect of incrementing not only the value of the number of strokes played at a given hole, but also the value of the total number of strokes played since the start of the game.

Initially, in a non-limiting preferred manner, the previously stored values for the number of strokes played at each hole and for the whole of the corresponding course can be reset to zero in memory zone 23. In order to do this, the user has to activate the golf mode for a given player and make a long application of pressure on stem-crown 8 in order to place it in its pushed-in position B, during a predefined period of time of the order of five seconds for example.

At the start of a game, when the wearer of watch 1 activates the golf mode, minute hand 10 is placed facing the indication "1" of first scales 12 of dial 5. At the same time, hour hand 9 is positioned facing second scales 13, at the value of the number of strokes played at the first hole during the preceding game, whereas second hand 11 is positioned facing the 9 o'clock position. The wearer then simply initialises the values stored during the previous game by a long application of pressure on stem-crown 8 before starting the new game.

At each stroke played at the first hole, the wearer of the watch makes a short application of pressure on stem-crown 8 in order to increment the stored value of the number of strokes played. As already mentioned, the value displayed by rings 15 and 16 through the aperture is incremented simultaneously with the incrementation of the number of strokes played at the current hole. When the first hole is finished, the wearer drives stem-crown 8 in rotation, preferably in the clockwise direction, to increment the number of the current hole, until minute hand 10 jumps to face the indication "2" of first scales 12. These operations are then repeated for each of the holes played until the end of the game.

At any time during the game, the wearer can recall the scores for the holes already played, by rotating stem-crown 8 in the anti-clockwise direction. Minute hand 10 then moves towards the hole numbers in decreasing order while hour hand 9 indicates, for each of the holes, the stored value of the number of strokes played.

In addition to having excellent display legibility, the watch according to the present invention offers exception conviviality from the point of view of use and the manipulations necessary to navigate its various operating modes.

Indeed, owing to the particular arrangement of integrated circuit 20 and the display means, it is possible, at any point in the game, to display the number of strokes played at any of the preceding holes, including the hole currently being played, solely by carrying out elementary manipulations.

Of course, those skilled in the art are capable of programming integrated circuit 20 of the watch according to the present invention as they wish, to provide responses respectively suited to the various possible actions on stem-crown 8.

Moreover, it will be noted that it is also possible for a single player to use the four positions corresponding to the sectors of bezel 7 bearing the indications "1" to "4", each of these sectors then being associated with a given golf course.

According to a variant of the embodiment that has just been described, a second memory zone 24 can be provided to store the features of a given golf course, particularly in terms of par. It is in fact possible for the user to input the par of each of the holes of a given course. For this purpose, when the watch is in golf mode, integrated circuit 20 of the watch is arranged to activate an "input" mode in response to detection of stem-crown 8 being positioned in its pulled-out position C.

The second memory zone 24 is preferably of the reprogrammable volatile type (Flash or EPROM, for example) to allow subsequent updating of the stored data, particularly when the user plays on a different golf course to that for which data is stored.

Moreover, the architecture previously described in relation to first memory zone 23 can also be envisaged for second memory zone 24, for storing the par associated with each of the 18 holes of a given golf course.

In the "par input" mode, rings 15 and 16 can optionally be driven in rotation by the motor control means 25 so that only the indication "P", carried by outer ring 16, appears through aperture 14. Such an indication indicates to the user of watch 1 that the latter is in the golf course feature input mode.

Thus, when a given hole is selected, the corresponding part can be inputted when stem-crown 8 is driven in rotation in its pulled-out position C. The par value is incremented by rotating the stem-crown in a first rotational direction and decremented in the other direction. The value thereby obtained is stored in memory zone 24 when stem-crown 8 is pushed into its rest position A.

Integrated circuit 20 of the watch according to this variant can be programmed such that the second hand 11 is also controlled so as to display information relating to golf play in golf mode. In fact, second hand 11 can be controlled so as to indicate the number of the hole being played facing first scales 12 of dial 5, while hour hand 9 and minute hand 10 are controlled so as to indicate respectively the par value and number of strokes played at that hole, facing second scales 13.

This distribution of the indications provided by the time display hands in golf operating mode enables the watch according to the present invention to offer excellent legibility to its user. In particular, the wearer of the watch can, at a glance, estimate his situation as regards the par of a given hole during the game of golf.

At the start of the game, when the wearer of watch 1 activates golf mode, second hand 11 is placed facing indication "1" of the first scales 12 of dial 5. At the same time, hour hand 9 and minute hand 10 are positioned facing second scales 13, respectively at the value of the number of strokes played at the first hole during the preceding game and at the par value of the first hole stored in second memory zone 24. For the sake of simplification, it will be assumed that the par values preset at this stage correspond to the golf course being played. The wearer then simply initialises the values, other than the par, stored during the preceding game by a long application of pressure on stem-crown 8 to place it in its pushed-in position B, before starting the new game.

Preferably, the manipulations to be made to stem-crown 8 during the golf game are identical to those previously described and will not be described again in detail.

However, it should be noted that it is also possible for a single player to use the four positions corresponding to the sectors of bezel 7 bearing the indications "1" to "4", each of these sectors then being associated with a given golf course. For this purpose, the par values stored in the memory for the first player are generally, by default, automatically duplicated in the locations of memory zone 24 corresponding to the three other players. If, however, a single player wishes to use the watch for several golf courses which he usually plays, he has to input new par values for the next golf courses, the new values inputted erasing the values stored by default when the values of the first course are inputted.

Figure 3:
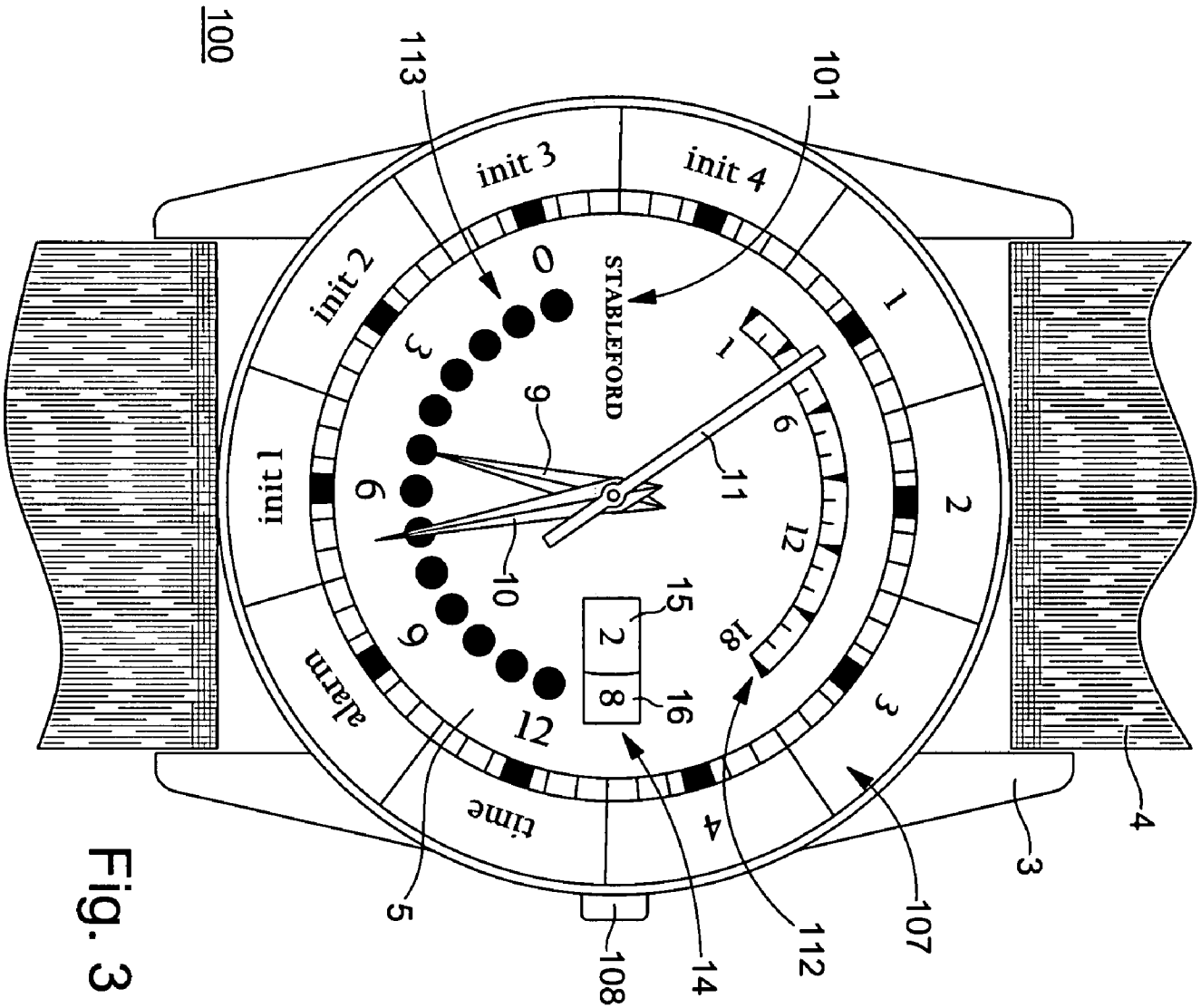
FIG. 3 shows a schematic front view of a portable electronic timepiece according to a second preferred embodiment of the present invention.

FIG. 3 shows a second embodiment of the electronic timepiece according to the present invention, in a similar view to that of FIG. 1.

The timepiece or watch 100 according to this second embodiment has a very similar external appearance to that which has just been described with reference to the first embodiment. Consequently, those elements that have already been described in relation to FIG. 1 bear the same reference numerals in FIG. 3, for the sake of simplification.

Dial 5 bears an additional indication 101, "stableford", which allows this embodiment to be differentiated from the previous embodiment. Moreover, the first and second scales 112 and 113 extend respectively over substantially shorter lengths than scales 12 and 13 of the first embodiment.

Watch 100 shows an additional example embodiment of the electronic timepiece according to the present invention, in accordance with which the arrangement of integrated circuit 20 is different from that which has just been described.

Rotating bezel 107 is similar to bezel 7 of the first embodiment and also comprises ten contiguous sectors corresponding to different operating modes of watch 100.

The bezel comprises four sectors bearing the respective indications "1" to "4", and four additional sectors, bearing the indications "init1", "init2", "init3" and "init4", these eight sectors corresponding to different functions of the golf mode. One sector bearing the indication "time" is provided for activating the time operating mode as well as a sector bearing the indication "alarm" for activating, deactivating or setting a similar alarm function to that previously described.

Preferably, stem-crown 8 has four axial positions, a neutral or rest position A, a pushed-in position B, a first pulled-out position C and a second pulled-out position D.

As indication 101 suggests, watch 100 according to the second embodiment of the present invention enables its user to keep the score of a game of golf in accordance with the "stableford" method. Of course, the present invention is in no way limited to the strict application of the corresponding rules. Indeed, those skilled in the art could programme the integrated circuit of the watch in a different way in order to apply different score keeping rules, for example an "amended stableford" method, without departing from the scope of the present invention.

Preferably, integrated circuit 20 of watch 100 is arranged to allow the persons wearing it to choose between the conventional score keeping system or the "stableford" system.

FIG. 3 shows the appearance of watch 100 in a given game configuration while the score keeping system implemented is a conventional system.

In such case, hour hand 9, minute hand 10 and second hand 11 respectively indicate the par value of the hole being played and the value of the number of strokes played at that hole, opposite second scales 113, and the value of the hole number being played opposite first scales 112. This configuration provides an additional advantage from the point of view of legibility since the par is permanently displayed for each hole being played during the golf game. Thus, the wearer of the watch 100 can have an idea, at a glance, of his situation at a given hole with respect to the corresponding par.

The manipulations of stem-crown 108 in this scoring system are identical to those which were described in relation to the first embodiment.

Additional manipulations are however provided to allow the score to be kept in the "stableford" scoring system. In this scoring system, each hole has a handicap value in addition to its par. This handicap value can be set for a given hole, from golf mode, when stem-crown 108 is placed in its second pulled-out position D, then rotated in one direction or the other to increment or decrement the handicap value.

The "stableford" scoring system also comprises a handicap value associated with each of the players. The respective handicap values of four players can be inputted and stored in memory zone 23, when bezel 107 is in a configuration such that the four respective sectors bearing the indications "init1" to "init4" are placed at 12 o'clock. In this case, minute hand 10 moves first of all opposite first scales 112 to indicate the handicap of the selected player. When stem-crown 108 is placed in its first pulled-out position C, rotation thereof causes an alteration to the handicap value of the player concerned.

Preferably, at the same time, integrated circuit 20 produces a signal to be sent to motor control circuit 25 to move second hand 11 such that it is placed, immobile, opposite the 9 o'clock position, in other words superposed on the "stableford" indication 101.

In addition, memory zone 24 comprises a programme adapted to keep the score in accordance with the "stableford" method, which allows integrated circuit 20 to calculate each player's score in accordance with this method during the entire game of golf. Preferably, each player can consult his "stableford" score at any time by arranging bezel 107 so as to display his handicap, as described hereinbefore, rings 15, 16 being controlled in this mode so as to display simultaneously the "stableford" score value through large aperture 14.

It should be noted that the electronic timepiece according to this embodiment has different functions to that of the first embodiment while proposing, in a similar manner, a display that is easy to read and very simple control member manipulations in order to change the operating mode or input data.

As in the preceding embodiment, the use of the same display members for the time mode and golf mode advantageously avoids overloading dial 5 of watch 100, while preserving a character size, for the various indications, that is amply sufficient to ensure good legibility.

Furthermore, the subsequent use of the inputted data, such as the number of strokes played at a given hole, is very convivial because of the memory storage structure for such data, and the programming of integrated circuit 20 according to the present invention.

The preceding description corresponds to preferred embodiments of the invention and should in no way be considered limiting, more specifically as regards the structure described for the watch, the nature and number of control members used or even the position of the scales. Variants could be imagined in which the timepiece according to the present invention comprise additional functions such as a compass function for example. Likewise, the invention is not limited to the operating modes described and means used for respectively activating them insofar as these parameters can be modified by suitable programming of the controller circuit. Those skilled in the art will not encounter any particular difficulty in adapting the operation of the watch according to the present invention to fit their particular requirements.

What is claimed is:

1. A portable electronic timepiece with a golf score keeping function comprising a case containing a watch movement above which there is mounted a dial, said watch movement including electronic circuits able to generate time signals to be sent to motor means respectively controlling at least a first and a second analogue display member, said analogue display members being arranged above the dial to display the current time in a first operating mode called the time mode, wherein said timepiece has a second operating mode, or golf mode, in which said electronic circuits are arranged for generating control signals to be sent to said motor means, to display information relating to golf play, by said first and second analogue display members.

2. The timepiece according to claim 1, wherein said timepiece includes at least one control member as well as storage means, said electronic circuits being arranged in golf mode to produce first electrical signals to be sent to said motor means on the basis of predefined manipulations of said control member, said electrical signals being representative in particular of the number of strokes played by the wearer of the timepiece for a given hole of a golf course, so that a first of said analogue display members indicates the number of said hole, the second of said analogue display members indicating the number of strokes played at said given hole, said electronic circuits also being arranged for transmitting said first electrical signals to said storage means in order to store data representative of the number of strokes played for a given hole of said golf course.

3. The timepiece according to claim 2, wherein said electronic circuits and said storage means are arranged for storing said data relating to each of the holes of said golf course.

4. The timepiece according to claim 3, wherein said electronic circuits are further arranged for producing second electrical signals to be sent to said motor means, on the basis of said stored data and in response to a predefined manipulation of said control member, such that said first of said analogue display members indicates a number of a previously played hole whereas said second of said analogue display members indicates the corresponding number of strokes played.

5. The timepiece according to claim 2, said control member being a stem-crown having in particular a pushed-in position, wherein in the golf mode, said electronic circuits are arranged so that a rotation of said stem-crown in the clockwise direction increments the hole number, a rotation of said stem-crown in the anti-clockwise direction decrements the hole number, whereas an application of pressure on the stem-crown causes an increment of the number of strokes played for a given hole.

6. The timepiece according to claim 1, wherein said dial has an aperture through which digital display means are visible, said digital display means being controlled by said electronic circuits to display the total number of strokes played since the start of a game in golf mode.

7. The timepiece according to claim 6, wherein the digital display means are controlled, in said time mode, so as to indicate a date.

8. The timepiece according to claim 6, wherein said digital display means include two concentric rings bearing figures and driven in rotation by said motor means.

9. The timepiece according to claim 1, wherein said timepiece includes at least a third analogue display member controlled so as to indicate the second in said time mode and additional information relating to golf play in golf mode.

10. The timepiece according to claim 9, wherein, in golf mode, said motor means are arranged for controlling a first of said analogue display means such that it indicates the number of said hole, a second of said analogue display means such that it indicates the number of strokes played at said given hole and, the third analogue display member such that it indicates the corresponding par of said given hole.

11. The timepiece according to claim 1, wherein said timepiece includes at least a third analogue display member controlled such that it indicates the second in said time mode and remains immobile opposite a predefined position in golf mode.

12. The timepiece according to claim 1, wherein said timepiece further includes a rotating bezel arranged for fulfilling the function of a control member when activated.

* * * * *